US006219647B1

(12) United States Patent
Hidding et al.

(10) Patent No.: US 6,219,647 B1
(45) **Date of Patent: *Apr. 17, 2001**

(54) METHOD AND AN APPARATUS FOR PREPROCESSING LOGGING OF RECEIVED POSTAL ITEMS

(75) Inventors: G. Hidding, Heerenveen; B. Edens, Drachten; J. Gortemaker, Lippenhuizen, all of (NL)

(73) Assignee: Hadewe, B.V., Drachten (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/868,590

(22) Filed: Jun. 4, 1997

(30) Foreign Application Priority Data

Jun. 4, 1996 (NL) ..... 1003265

(51) Int. Cl.[7] ..... G06F 17/60

(52) U.S. Cl. ..... 705/1; 53/492; 209/3.3; 209/584

(58) Field of Search ..... 705/1; 53/492, 53/55; 382/101; 209/584, 604, 3.3, 539

(56) References Cited

U.S. PATENT DOCUMENTS

| | | | | |
|---|---|---|---|---|
| 3,587,856 | * | 6/1971 | Lemelson | 382/101 |
| 3,674,924 | * | 7/1972 | Fischer et al. | 348/91 |
| 3,760,161 | * | 9/1973 | Lohne et al. | 382/101 |
| 4,138,102 | * | 2/1979 | Palmer | 271/3 |
| 4,921,388 | | 5/1990 | Nelson | 414/412 |
| 5,034,985 | * | 7/1991 | Keough | 382/101 |
| 5,131,545 | * | 7/1992 | Owen | 209/604 |
| 5,175,979 | * | 1/1993 | van der werff et al. | 53/492 |
| 5,179,820 | * | 1/1993 | van der werff | 53/492 |
| 5,191,525 | * | 3/1993 | LeBrun et al. | 364/419 |
| 5,293,431 | * | 3/1994 | Hayduchok et al. | 382/101 |
| 5,444,840 | * | 8/1995 | Froessl | 395/145 |
| 5,510,997 | * | 4/1996 | Hines et al. | 700/224 |
| 5,602,936 | * | 2/1997 | Green et al. | 382/140 |
| 5,852,918 | * | 12/1998 | Hidding et al. | 53/492 |

FOREIGN PATENT DOCUMENTS

| | | | |
|---|---|---|---|
| 0571308 | * | 11/1993 | (EP) . |
| 95/17975 | | 7/1995 | (WO) . |

OTHER PUBLICATIONS

No author; "Office Automation; productivity through integration" 11/1984; Forbes v134, p161(16), DialogWeb copy pp. 1–18.*

* cited by examiner

*Primary Examiner*—Emanuel Todd Voeltz
*Assistant Examiner*—Thomas A. Dixon
(74) *Attorney, Agent, or Firm*—Burns, Doane, Swecker & Mathis, L.L.P.

(57) ABSTRACT

From received postal items patterns are recorded and recorded information representing the recorded patterns is generated. Each received postal item is processed directly after the information is recorded from the postal item. The information representing the recorded patterns is stored in a log of received mail. Since the recordal of the pattern is carried out before the step of processing, any log or archive prepared on the basis of the initial recording step will include any documents which are lost or damaged during the subsequent processing.

21 Claims, 4 Drawing Sheets

METHOD AND AN APPARATUS FOR PREPROCESSING LOGGING OF RECEIVED POSTAL ITEMS

TECHNICAL FIELD

The invention relates to a method and an apparatus for processing received postal items. Such methods and apparatuses are typically employed in mailrooms.

BACKGROUND ART

In European patent application 0 571 308 a method for processing received postal items is described in which, for each one of a plurality of received postal items, at least one pattern is recorded from the received postal item, recorded information representing the at least one recorded pattern is generated, and the received postal item is processed in accordance with processing instructions represented by the information recorded from the postal item.

Also disclosed in this document is an apparatus for processing received postal items, equipped with a registration assembly for recording patterns from received postal items and for generating recorded information representing the recorded patterns, and a processing structure connected to the registration assembly for processing received postal items in accordance with processing instructions represented by the information recorded from the postal items.

The recording of a pattern is for example carried out by scanning a bar-code pattern on a document or an envelope and the processing includes the sorting and routing of documents to different remittance processing devices responsive to coded information obtained by scanning the bar-code pattern of the respective envelope.

Direct integrated processing of received mail provides efficiency advantages in that it eliminates the need of handling batches of mail between successive processing operations. However, there is a need of efficiently preparing and maintaining records of incoming mail which can serve as a log for data regarding received mail. For example, in some organizations all envelopes in which mail has been received are stored for some time so that any items or data in or on these envelopes can be retrieved if necessary. It is also common practice to prepare lists of mail which has been received, but in combination with integrated processing of received mail, this entails the problem that items which have gone astray during the processing are missed.

SUMMARY OF THE INVENTION

It is an object of the present invention to provide a solution for efficiently obtaining data in an integrated mail processing system.

According to the invention, this object can be achieved by providing a method of of processing received mail in which the information representing the recorded pattern or patterns is stored in a log of received mail. Further, according to the invention, an apparatus suitable for carrying out this method can be provided by an apparatus of the initially identified type further provided with a data storage unit for storing a log of received mail, the storage unit being connected to the registration assembly for storing the recorded patterns in the log of received mail.

Since the recordal of a pattern from a postal item is carried out before the step of processing, any log or archive prepared on the basis of the same recording step will include any documents which are lost or damaged during the subsequent processing.

It is noted that the processing operation can be a routing or sorting operation as is known from the above-discussed European patent application. However, the processing operation can also include other steps, such as marking documents with a file number, opening envelopes, discarding junk mail, destroying documents with confidential information (while storing its contents in a file with limited access) or registering in a database that a response to a request has been received.

Particular objects, embodiments and advantages of the present invention are set forth below in the detailed description, the accompanying drawings to which reference is made in the description and in the claims.

MODES FOR CARRYING OUT THE INVENTION

Figure 1:
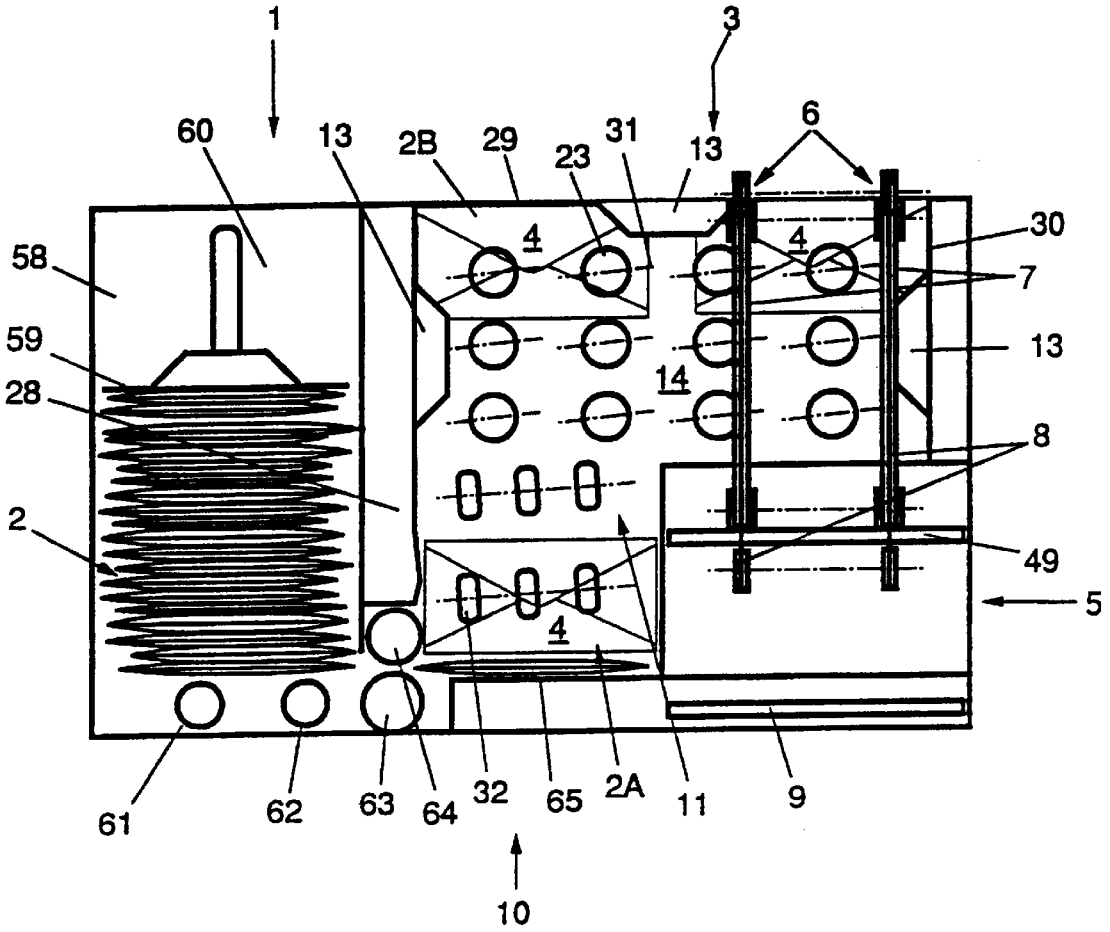
FIG. 1 is a schematical top plan view of an example of an apparatus according to the invention.

The exemplary embodiment shown in the drawings represents the presently most preferred embodiment of an apparatus according to the present invention. The basic layout of the apparatus corresponds to that of an apparatus for extracting contents from envelopes which is being manufactured by HADEWE B. V. in Drachten, The Netherlands and is commercially available under the type designations IM-35 and LE-1. For further details, reference is made to U.S. Pat. Nos. 5,179,820 and 5,175,979, the contents of which is hereby incorporated by reference.

Figure 2:
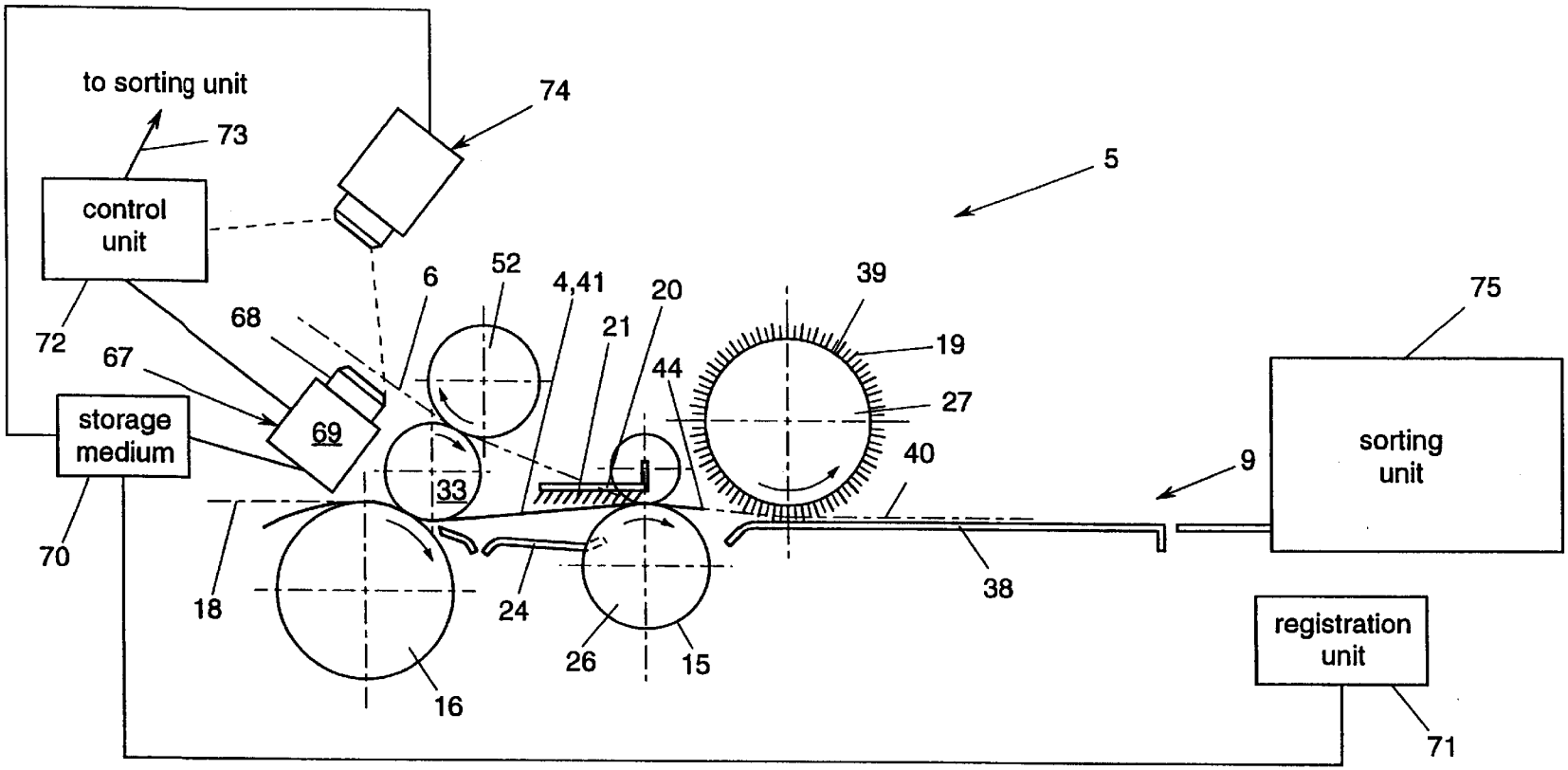
FIGS. 2–4 are cross-sectional side elevational views of the separating portion of the apparatus according to FIG. 1.
Figure 3:
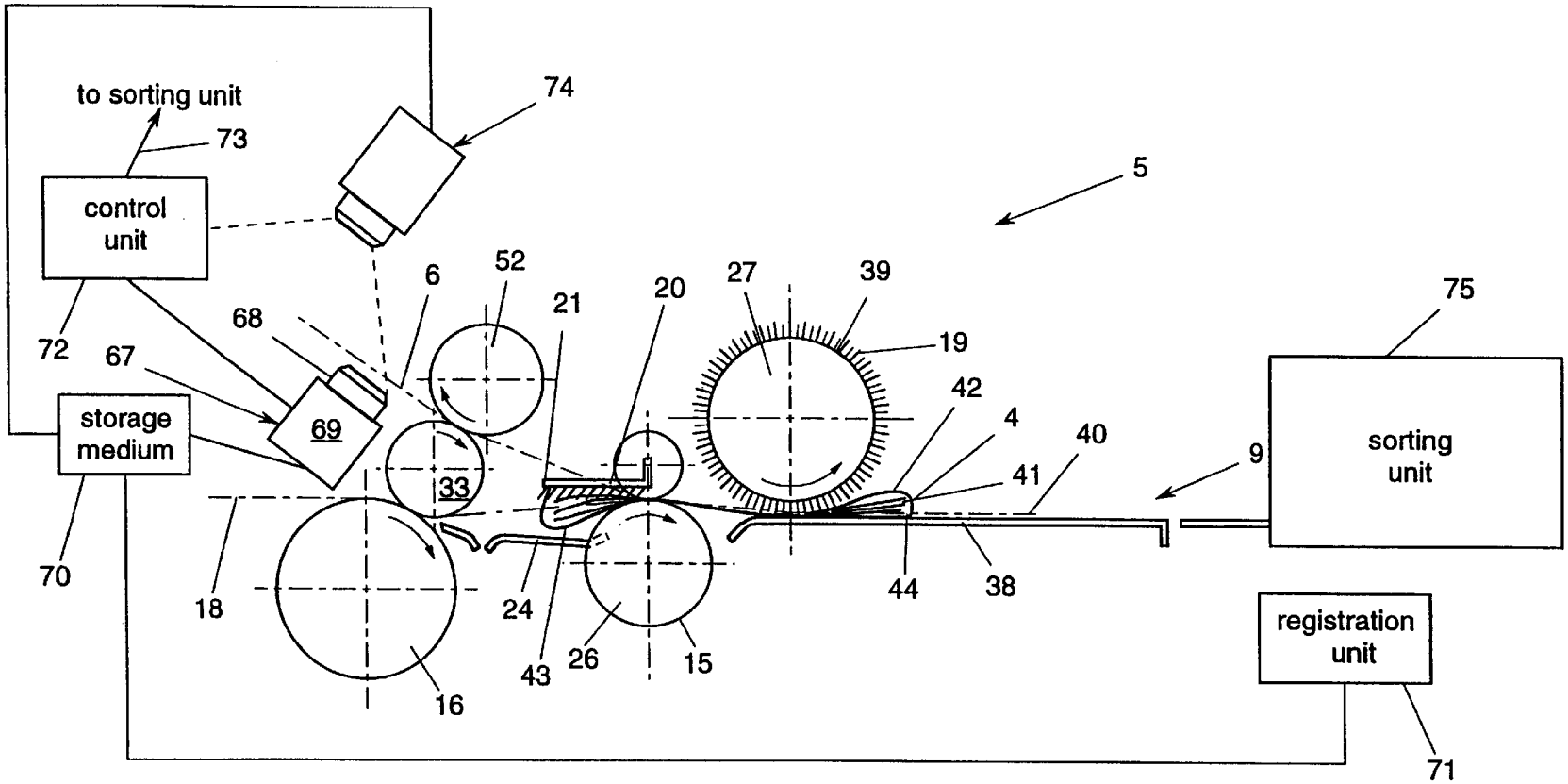
Figure 4:
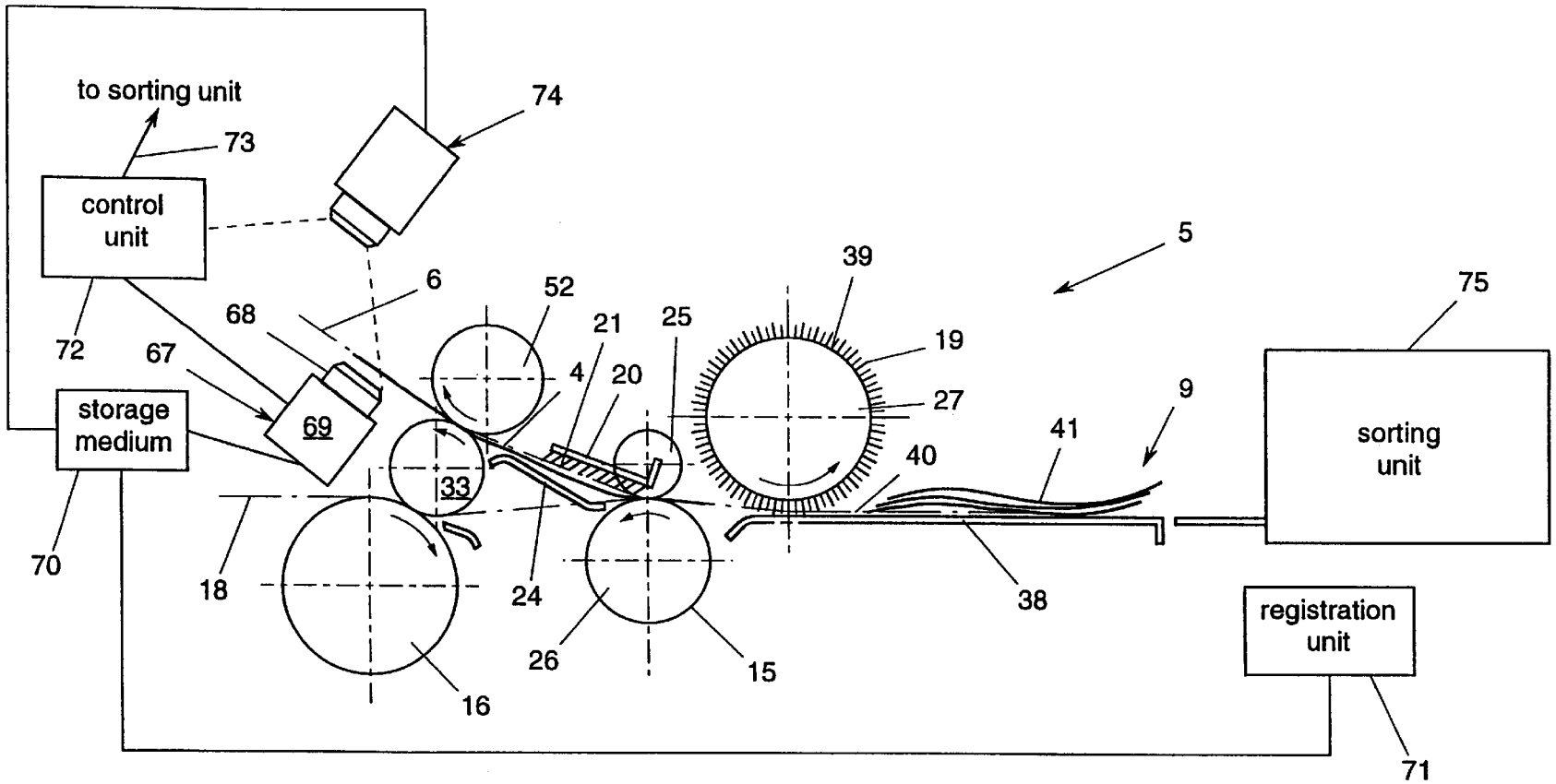

The apparatus according to the shown exemplary embodiment of the invention comprises three main processing stations: first, a holder station 1 for accommodating and supplying piece by piece postal items 2 to be processed, second, an opener 3 for separating a front wall and a rear wall of an envelope 4 of a postal item 2 from each other along three of the folding edges of that envelope 4, and third, a separator 5 for separating the envelope 4 from its contents (this separator is shown in greater detail in FIGS. 2–4).

The holder station 1 for supplying postal items 2 piece by piece is provided with a storing space 58 in which the postal items to be processed can be placed. Mounted in the storing space is a hold-down support 59 for sliding movement along a guiding slot 60. The hold-down support 59 is connected with means (not shown) for pushing the stack of postal items 2 to be processed to the operating side 10. Provided or the operating side 10 of the storing space 58 are a support roller 61 and a supply roller 62. Further, near the operating side 10 on the side of the opener 3 a transport roller 63 and a separation roller 64 are mounted, the transport roller 63 being arranged on the operating side 10 relatively to the separation roller 64.

For processing a stack of postal items, the hold-down support 59 is moved away from the operating side 10 and the stack of postal items 2 is horizontally placed between the hold down support 59 and the supply rollers 61 and 62 so that the envelopes are in a line one behind the other in substantially upright position. Then the hold-down support 59 is pressed against the stack of postal items 2 for exerting a press-on force on the stack in the direction of the operating side 10. When the apparatus is operated for processing a postal item the supply roller 62 and the transport roller 63 are actuated. Further, the separation roller 64 is driven, but it travels along with the transport roller 63 as long as no more than one postal item 2 is disposed between the separation roller 64 and the transport roller 63.

The action of the supply roller 62 causes the outer-most postal item on the operating side 10 of the stack to be moved towards the transport roller 63 which carries the postal item along upon engagement with it. After the transport roller 63 engages the outer-most postal item the drive of the supply roller 62 is disengaged. Any following postal items that are carried along by the outer-most postal item are restrained by the separation roller 64 and upon entering the area between the transport roller 63 and the separation roller 64 are returned to storing space 58 by the separation roller 64.

The outer-most postal item is transported by the transport roller 63 to be arranged before a wall 65 on the operating side 10 of the opener 3. Then the postal item is tilted away from said wall 65 for the item to assume a flat position lying on the guiding surface 14. From this flat position, the postal item is transported further to the opener 3.

The opener 3 for severing the front wall and the rear wall of each envelope comprises a rectangular guiding surface 14 having a left-hand guiding edge 28, viewed from the operating side 10, a rear guiding edge 29 and a right-hand guiding edge 30. For transporting a postal item 4 along these guiding edges 28, 29 and 30, the opener 3 is provided with driven and steerable transport rollers 23. Each of the guiding edges 28, 29 and 30 is provided with a cutting member 13 arranged substantially centrally and operative at some distance from the respective guiding edges for cutting open the envelope along a folding edge.

The opener has a supply opening 11 between the holder station 1 and the separator 5. In the area of this supply opening 11 transport rollers 32 are arranged obliquely relatively to the left-hand guiding edge 28 so that postal items 2 upon being transported through the opening 11 are urged against the left-hand guiding edge 28.

When a postal item is fed through the supply opening 11 from a position designated by the reference numeral 2A, the rollers 23 are rotated, their centre lines 31 being held in a position substantially transverse to the left-hand guiding edge 28. The centre lines 31 may be held in a slightly oblique position with the right-hand side of each of the rotationally symmetrical elements being disposed at a greater distance from the operating side than the left-hand side, as shown in FIG. 1. Thus the postal item is continuously urged against the left-hand guiding edge 28. Upon passing the cutting member 13 provided along the left-hand guiding edge 28, the postal item is cut open along the folding edge that is turned towards this left-hand guiding edge 28.

The postal item is transported along the left-hand guiding edge 28 until it reaches the rear guiding edge 29. The position in which the rear guiding edge 29 has been reached is designated by the reference numeral 2B in FIG. 1. Then, the rollers 28 are rotated about corresponding axes transverse to the guiding surface 14 until the centre lines 31 are in a position substantially transverse to the rear guiding edge 29. The centre lines 31 of the rotationally symmetrical elements may be held in an oblique position relative to the rear guiding edge 29 in a similar way as described with reference to the left-hand guiding edge 28. Upon passing the cutting member 13 provided along the rear guiding edge 29, the envelope is cut open along the second folding edge turned towards this guiding edge 29.

When next the postal item subsequently reaches the right-hand guiding edge 30, the rollers are rotated about associated steering axes in a similar way as when reaching the rear guiding edge 29. The position in which the right-hand guiding edge 30 has been reached is designated by reference numeral 2C in FIG. 1. From that position the postal item is thereby passed along the right-hand guiding edge 30 to the separator 5. In the meantime, the envelope is cut open along the third folding edge turned towards this guiding edge 30.

The separator 5 has a supply opening contiguous to the surface 14 of the opener 3 and a transport track 18 extends through that opening (see FIGS. 2–4). The separator 5 further has an exit 9 on the operating side 10 for discharging processed contents and, in an upper position, a discharge opening 49 for discharging processed envelopes.

The separator 5 is adapted for unfolding the envelope 4 and for transferring the envelope 4 to the exit track 6 in an unfolded condition for discharging envelopes 4 which have been separated from their contents.

A portion of the exit track 6 is designed in the form of superjacent and subjacent belts 7 and 8 of resilient material in between which belts an envelope can be clamped. If necessary, an envelope can easily be removed by hand from between the belts 7 and 8. In the exit track 6, any part of the contents that happens to be removed along with the envelope is not separated from the envelope in an uncontrolled manner, which might lead to that part being lost.

The separator 5 is further described with reference to the FIGS. 2–4 in which an example of a separator 5 is shown in combination with an envelope 4 and a contents 41 being processed in successive operating stages. The envelope has a first wall 42 and a second wall 43 (in FIG. 3 separately visible), which are mutually connected along a fold 44 along the fourth side.

A transport track 40 extends through the separator 5, along which track a guiding plate 24, a guiding roller 25, a transport roller 26, a friction roller 27 and a retaining surface 38 are provided. The friction roller 27 and the retaining surface 38 form friction surfaces arranged on opposite sides of the transport track 40 and facing each other. When the envelope is supplied (FIG. 2) the friction roller 27 is in a position lifted from the retaining surface 38, so that the envelope can be brought in a position between the friction roller 27 and the retaining surface 38 by rotating the transport roller 26 and the guiding roller 25. The friction roller 27 and the retaining surface 38 are then pressed towards each other for exerting a pressure to the envelope (FIG. 3) and can be moved relatively to each other parallel to the transport track 40. This is achieved by retaining the retaining surface 38 relatively to the position of the transport roller 26 and the guiding roller 25 and urging the friction roller 27 towards the retaining surface 38 and rotating it in such a way that portions of the circumference 39 of the friction roller 27 facing the retaining surface 38 move away from the guiding roller 25 and the transport roller 26. Preferably the transport roller 26 is kept blocked and the guiding roller 25 rotates freely with the displacements of the panel 42, 43 of the envelope 4 with which it is in contact.

The envelope 4 is clamped between the friction roller 27 and the retaining surface 38, and a portion of the first panel 42 against which the friction roller 27 is pressed, is slid relatively to the second panel 13 in the direction of the fold 44 and pivoted about the fold 44 (se FIG. 3). When the first panel 42 is unfolded, the contents 41 are accessible to the friction roller 27 and the contents 41, which lies on the second panel 43, is slid over the first panel 42 in the direction of the free edge opposite the fold 44 until the contents 41 is free from the friction roller 27.

As appears from FIG. 3, the friction roller 27 is lifted off the retaining surface 38 after the contents 41 of the envelope 4 have come clear of that roller 27. Then the transport roller 26 is rotated in such a direction that the portions of its circumference 15 facing the guiding roller 25 move away from the retaining surface 38. The guiding plate 24 is part of a switch structure connecting the envelope supply track 18 and an exit track 6 for emptied envelopes 10 with the transport track 40. In FIG. 4 the guiding plate 24 is extended upwards so as to guide the envelope 4 supplied by the transport roller 26 to the beginning of the exit track 6, which beginning is formed by oppositely arranged portions of an intermediate roller 33 between a supply roller 16 of the supply track 18 and a discharge roller 52 of the exit track 6.

Since the envelope 4 is removed in a direction which is substantially opposite to the direction of the sliding movement of the first panel 42 and the contents 41 are slid in the direction of that sliding movement, the envelope 4 is automatically separated from its contents 41.

Concentrically with the friction roller 27 sweeping means 19 are provided which can be rotated along the retaining surface 38 with a slight pressure. Any contents 41 which may be entrained with the envelope 4 is swept off the envelope 4 when the envelope 4 is being removed by rotating the sweeping means 19. By restraining the sweeping means 19 from rotation relative to the friction roller 27, their sweeping action can be controlled by continuing the rotation of the friction roller after it has been lifted off the envelope 4. The sweeping means 19 further support the pivotal movement of the first panel 42 after it has come clear of the friction roller 27.

Spaced from the transport track 40 and the friction roller 27, a restraint 20 is provided, the friction roller 27 and the restraint 20 being disposed on the same side of the transport track 40 and portions of the circumference 39 of the friction roller 27 facing the retaining surface 38 being moveable away from the restraint 20.

When in the area of separation edges opposite the fourth folding edge 44, connections between the first and the second panel 12 and 43 are present, a portion of that envelope 4 adjoining the separation edges opposite the fourth folding edge 44 curls and, from the moment where a certain degree of curling is reached the edge of the second panel 43 opposite the fourth folding edge 44 is at least locally be prevented from following the first panel 42 (see FIG. 3). As a result, the first and the second panel 42 and 43 are drawn apart along the edges opposite the fourth folding edge 44, so that the connections between the first and the second panel 42 and 43 are ruptured. The envelope 4 is now unfolded in spite of the separation edge opposite the fourth folding edge 44 not having been cut open completely.

According to the embodiment shown, the restraint 20 comprises a short-haired brush 21 so that the separation edge of the second panel 43 is reliably restrained substantially directly upon checking the restraint 20, regardless of the position where it meets the restraint 20.

The switch formed by the guiding plate 24 is disposed on the same side of the friction surfaces 27, 28 as the restraint 20. Thus, as explained hereinabove, the envelope 4 can readily be discharged in a direction opposite the direction of discharge of the contents 41. A further advantage is that the guiding plate 24 can be coupled with the restraint 20 so that the plate 4—as shown in FIG. 4—can be pivoted upwards away from transport track 40 for guiding a processed envelope 4 to the exit track 6.

When the processing of an envelope 4 has passed the stage shown in FIG. 3 and the first panel 42 as well as the contents 41 between the friction roller 27 and the retaining surface 38 have been removed, so that only the second panel 43 of the envelope 4 is left between the friction roller 27 and the retaining surface 38, operation of the friction roller 27 is to be interrupted. As discussed hereinabove, this is effected in the present embodiment by shifting the friction roller 27 away from the retaining surface 38.

To determine the moment at which the operation of the friction roller 27 is to be interrupted, the apparatus is provided with a sensor for generating a signal dependent on the resistance the friction roller 27 is subject to, the sensor being coupled for interrupting the operation of the friction roller 27 when the resistance sustained by the friction roller 27 exceeds a predetermined level.

For recording patterns or images from received postal items, the shown apparatus is provided with a registration unit 67 for recording a pattern of the outside of each envelope 4. The registration unit 67 is positioned relative to the inverting structure for pivoting a wall of the envelope 4, such that, in operation the recording of a pattern of one or both of the walls 42, 43 takes place after inverting the wall 42 of the envelope. In the shown embodiment, this is achieved by positioning the recording unit 67 along the exit track 6 where the envelopes always pass in an opened condition.

In operation, of each envelope (which has at least been weakened along at least all but one of its fold-edges), first the front or the rear panel is inverted relative to the other panel. Subsequently, the envelope is separated from the contents received in that envelope 4. Each time after that, i.e. each time after the front or the rear wall has been inverted, a pattern is recorded from the envelope by means of the registration unit 67.

Downstream of the separator 5 a processing structure in the form of a sorting unit 75 is provided. The sorting unit 75 is connected to the registration unit 67 for processing received postal items in accordance with processing instructions represented by the information recorded from said postal items. It is noted that the processing unit can be provided in many other forms, such as in the form of a remittance processing unit.

Furthermore, a data storage unit 70 for storing a log of received mail is provided. This storage unit 70 is connected to the registration unit 67 for storing the recorded patterns in a log of received mail.

In operation patterns which are recorded from the received postal items 4 for the purpose of determining how the received postal item is to be processed are stored in a log of received mail. Thus, a single recording operation can be used for both determining features of the processing of received items and for building a log of received mail.

According to the example shown, the registration unit 67 in a bar code reader. The recorded code can for example be used for selecting a destination of the contents of the envelope. According to the invention the data scanned from the envelope can also be used for recording that the envelope has been received.

The recording of a pattern can be carried out in many ways. Instead of in the form of a scanner, the registration unit 67 can for example be provided in the form of a video camera or a microfilm camera for recording an image from an envelope which is held stationary relative to the camera.

The shown apparatus further includes a control unit 72 connected to the registration unit 67 for generating the processing codes in accordance with the signals representing the recorded patterns. The sorting unit 75 is connected to the registration unit 67 via the control unit 72 and responsive to the processing codes received from the control unit 72 for processing received postal items in accordance with the processing codes. In the sorting unit 75 each received postal item is directed to a selected one of different destinations in accordance with the processing code received from the control unit 72.

In the example shown, the data storage medium is connected to the registration unit 67. However, to allow storing the recorded data in a form adapted for storage, for example in a compressed form, it can be preferable to connected the data storage medium to the registration unit 67 via the control unit 72.

Since, in operation, information representing patterns recorded from received envelopes are stored in a log of received envelopes, the need of physically storing received envelopes to retain information contained on these envelopes is obviated.

Downstream of the exit 9, the transport track 18 forms a document track. Along that document track a second registration unit 71 is arranged for recording patterns from documents in that document track. In operation, patterns are recorded from documents of the received postal items and information representing these patterns is stored in a log of received documents. Thus also a log of received documents is automatically kept directly after the documents have been extracted. Thus the risk of documents being lost before having been recorded is minimized.

Preferably, it is provided that the data storage facilities are connected to both registration units 67 and 71 and configured for storing information representing patterns recorded from envelopes as well as information representing respective patterns recorded from respective ones of the documents in mutual association. This a complete log of recorded mail can be kept automatically and before any handling of the documents and the envelopes has taken place. It is noted that this feature is also advantageous if the recorded patterns are not used for determining the processing of received postal items.

To reduce the number of components, it can be provided that the registration assembly is formed by a scanner and a memory structure containing a program for storing information representing patterns scanned from envelopes and information representing patterns scanned from documents removed from each of the envelopes in mutual association on a data storage medium. Thus, the patterns can be scanned from documents and envelopes using a single scanner.

To ensure the authenticity of the records maintained on the data storage medium, it is preferably provided that the data storage medium 70 is protected against erasure or amendment of data stored thereon.

This can for example be achieved by providing that the data are stored in encrypted form. Examples of encryption techniques are well known in the art and for example described in a book entitled "PGP: Pretty Good Privacy" by Simson Garfinkel, O'Reilly & Associates, Inc. 1995, ISBN: 1-56592-098-8. It can for example be provided that time and date or any other relevant data of each entry in the records are coded by an independent institution using a private key, while a public key is provided to the user to allow reading of the encrypted data.

In the present example, the data storage medium 70 is a digital data storage medium to allow quick and simple storage of recorded patterns in digital form, more specifically, the data storage medium 70 is a write-once-read-many-times (WORM) storage medium formed by a recordable optical data storage disc.

However, it can also be provided that the data storage unit is formed by a printer or a microfilm or microfiche camera. It is noted that the microfilm can also be used for storage of data which have been processed in digital form.

Although in some applications, notably in the processing of highly standardized mail of a return type it can be sufficient to merely register indicia representing predetermined sorts of data, in many applications it is preferable to provide that the recording of pattern includes the recording of an image of the received postal item and that the recorded information represents that recorded image. This allows to retain virtually all the information contained in the received mail without physically having to store the received postal items.

Recording images from the received postal items 4 provides further advantages if the recorded information is processed for recognizing from which type of envelope the pattern has been recorded. Thus, it can for example be provided that postal items received from particular senders, which are recognizable by particular logo's or the like are automatically directed to selected departments.

What is claimed is:

1. A method for processing received postal items, comprising, for each one of a plurality of received postal items each including an envelope and contents within that envelope:

separating contents from an envelope in which the contents is received;

transporting the separated contents along a document track;

automatically recording at least one pattern from the separated contents of the received postal item each time directly after separation of the contents;

generating recorded information representing said at least one recorded pattern; and storing said information representing said at least one recorded pattern in a log of received mail.

2. A method according claim 1, including directing the contents of each received postal item to a selected one of different destinations in accordance with processing instructions represented by said information recorded from said postal item.

3. A method according to claim 1, wherein the patterns are recorded from at least envelopes of said postal items and said information representing said patterns recorded from said envelopes is stored in a log of received envelopes.

4. A method according to claim 1, wherein the patterns are recorded from at least documents of said postal items and said information representing said patterns recorded from said documents is stored in a log of received documents.

5. An apparatus according to claim 4, further including a separating structure for separating envelopes from documents received therein and a document track downstream of said separating structure and a recording unit arranged along said document track for recording patterns from documents in said document track, said data storage unit being connected to said registration assembly and configured for storing information representing patterns recorded from each of said envelopes and information representing respective patterns recorded from respective ones of said documents in mutual association.

6. An apparatus according to claim 5, wherein the registration assembly comprises a scanner and a memory structure containing a program for storing information representing patterns scanned from each of said envelopes and information representing patterns scanned from the documents removed from each of said envelopes in mutual association on a data storage medium.

7. A method according to claim 1, wherein, for each one of a plurality of received postal items, said information representing said at least one recorded pattern is stored in a form protected against erasure or amendment.

8. A method according to claim 7, wherein said information representing said at least one recorded pattern is stored in digital form.

9. A method according to claim 1, wherein the recording of said at least one pattern includes the recording of at least one image of said postal item, wherein said recorded information represents said at least one image and said at least one image is reproducible from said recorded informations.

10. A method according to claim 1, wherein said information recorded from said postal item is retained after the received postal item has been processed.

11. A method for processing received postal items, comprising, for each one of a plurality of received postal items each including an envelope and contents within that envelope:

separating contents from an envelope in which the contents is received;

transporting the separated contents along a document track;

automatically recording at least one pattern from the separated contents of the received postal item directly after separation of the contents;

generating recorded information representing said at least one recorded pattern; and storing said information representing said at least one recorded pattern in a log of received mail, wherein, for each one of a plurality of received postal items, the recording of a pattern includes the recording of a pattern from an envelope and the recording of a pattern from at least one document received in that envelope and wherein information representing said recorded pattern from said envelope and information representing said recorded pattern from said document are stored in mutual association.

12. A method for processing received postal items, comprising for each one of a plurality of received postal items;

recording at least one pattern from the received postal item;

generating recorded information representing said at least one recorded pattern; and storing said information representing said at least one recorded pattern in a log of received mail, wherein data of said information representing said at least one recorded pattern is stored in encrypted form using a private key, said encrypted data being readable using a public key associated with said private key.

13. An apparatus for processing received postal items each including an envelope and contents within that envelope, comprising:

a separator for separating contents of each received postal item from an envelope in which the contents is received;

a registration assembly directly downstream of the separator, for recording patterns from the separated contents of each of the received postal items and for generating recorded information representing said recorded patterns;

a document track for transporting contents from the separator to the registration assembly; and a data storage unit for storing a log of received mail, said data storage unit being connected to said registration assembly for storing said recorded patterns in said log of received mail.

14. An apparatus according to claim 13, further including a control unit connected to said registration assembly for generating processing codes in accordance with said signals representing said recorded patterns, said processing structure including a sorting unit for directing the contents of each received postal item to a selected one of different destinations, said sorting unit being connected to said registration unit via said control unit and responsive to said processing codes received from said control unit for directing the contents of each received postal items to a selected one of the different destinations in accordance with said processing codes.

15. An apparatus according to claim 14, wherein the data storage unit is connected to said registration unit via said control unit.

16. An apparatus according to claim 14, wherein said data storage unit includes a printer.

17. An apparatus according to claim 13, further including a document track, said registration assembly including a recording unit arranged along said document track for recording patterns from documents in said document track.

18. An apparatus according to claim 13, wherein said data storage unit includes a data storage medium protected against erasure or amendment of data stored thereon.

19. An apparatus according to claim 18, wherein said data storage medium is a digital data storage medium.

20. An apparatus according to claim 18, wherein said data storage unit includes a microfilm or microfiche camera.

21. An apparatus for processing received postal items each including an envelope and contents within that envelope, comprising:

a separator for separating contents of each received postal item from an envelope in which the contents is received;

a registration assembly directly downstream of the separator for recording patterns from the separated contents of each of the received postal items and for generating recorded information representing said recorded patterns;

a document track for transporting contents from the separator to the registration assembly;

data storage unit for storing a log of received mail, said data storage unit being connected to said registration assembly for storing said recorded patterns in said log of received mail; and an envelope track, said registration assembly including a recording unit arranged along said envelope track for recording patterns from envelopes in said envelope track.

* * * * *